US008016140B2

(12) United States Patent
Hsieh

(10) Patent No.: US 8,016,140 B2
(45) Date of Patent: Sep. 13, 2011

(54) COMBINATION SHELF WHOSE SUPPORT BOARDS CAN BE INCREASED

(76) Inventor: Ching-Chen Hsieh, Pitou Shiang (TW)

( * ) Notice: Subject to any disclaimer, the term of this patent is extended or adjusted under 35 U.S.C. 154(b) by 420 days.

(21) Appl. No.: 12/343,841

(22) Filed: Dec. 24, 2008

(65) Prior Publication Data

US 2010/0155352 A1 Jun. 24, 2010

(51) Int. Cl.
*A47H 1/00* (2006.01)

(52) U.S. Cl. ..... 211/187

(58) Field of Classification Search ..... 211/103, 211/187, 190, 207, 134; 108/147.11, 106, 108/147.12, 107, 147.13, 110, 147.14, 192, 108/147.15, 193
See application file for complete search history.

(56) References Cited

U.S. PATENT DOCUMENTS 3,424,111 A * 1/1969 Maslow ..... 108/147.13
3,664,274 A * 5/1972 Bustos ..... 108/147.13
4,128,064 A * 12/1978 Chung et al. ..... 108/192
4,158,336 A * 6/1979 Brescia et al. ..... 108/190
4,656,952 A * 4/1987 Schweizer ..... 108/11
4,811,670 A * 3/1989 Kolvites et al. ..... 108/107
4,852,501 A * 8/1989 Olson et al. ..... 108/107
5,676,263 A * 10/1997 Chang ..... 211/187
5,881,653 A * 3/1999 Pfister ..... 108/147.13
5,960,968 A * 10/1999 Wang ..... 211/187
6,015,052 A * 1/2000 Goldberg et al. ..... 211/187
6,044,988 A * 4/2000 Yang ..... 211/187
6,065,407 A * 5/2000 Wang ..... 108/147.13
6,079,575 A * 6/2000 Wang ..... 211/187
6,257,426 B1 * 7/2001 Masunaka et al. ..... 211/187
6,302,284 B1 * 10/2001 Zonshin ..... 211/187
6,357,611 B1 * 3/2002 Chen ..... 211/187
6,364,138 B1 * 4/2002 Chen ..... 211/187
6,364,139 B1 * 4/2002 Chen ..... 211/187
6,550,730 B1 * 4/2003 Hong ..... 248/219.4
6,659,410 B1 * 12/2003 Lu ..... 248/188
6,695,156 B1 * 2/2004 Wang ..... 211/187
6,748,878 B2 * 6/2004 Chen ..... 108/147.13
2002/0113180 A1 * 8/2002 Wiebe ..... 248/188
2003/0131767 A1 * 7/2003 Chen ..... 108/147.13
2004/0065633 A1 * 4/2004 Chen ..... 211/187
2004/0159623 A1 * 8/2004 Craft ..... 211/187
2005/0139562 A1 * 6/2005 Chen ..... 211/187
2007/0095773 A1 * 5/2007 Schwerman ..... 211/187
2010/0096352 A1 * 4/2010 Wang ..... 211/187
2011/0036278 A1 * 2/2011 Karl et al. ..... 108/147.13

* cited by examiner

*Primary Examiner* — Jennifer E. Novosad
(74) *Attorney, Agent, or Firm* — Alan Kamrath; Kamrath & Associates PA

(57) ABSTRACT

A combination shelf includes a plurality of upright posts, a plurality of mounting sleeves each detachably mounted on the respective upright post, at least one mounting frame mounted between the upright posts and detachably locked onto the mounting sleeves, a plurality of mounting brackets each detachably mounted on the respective upright post, and a plurality of support boards mounted between the upright posts and supported by the mounting frame and the mounting brackets. Thus, the mounting brackets are detachably mounted on the upright posts to support the support boards so that the support boards are selectively mounted between the upright posts, and the number of the support boards can be adjusted freely and randomly according to a user's practical requirement.

16 Claims, 7 Drawing Sheets

COMBINATION SHELF WHOSE SUPPORT BOARDS CAN BE INCREASED

BACKGROUND OF THE INVENTION

1. Field of the Invention

The present invention relates to a shelf and, more particularly, to a combination shelf for placing articles.

2. Description of the Related Art

A conventional combination shelf in accordance with the prior art shown in FIGS. 6 and 7 comprises a plurality of upright posts 60, a plurality of mounting sleeves 70 each mounted on a respective one of the upright posts 60, and a frame 80 mounted between the upright posts 60 and provided with a plurality of fixing sleeves 82 each detachably mounted onto a respective one of the mounting sleeves 70.

Each of the upright posts 60 has an outer wall provided with a plurality of retaining grooves 61. Each of the mounting sleeves 70 includes two clamping plates 75 detachably combined with each other and each detachably mounted on the respective upright post 60. One of the two clamping plates 75 of each of the mounting sleeves 70 is provided with two opposite slots 74, and the other one of the two clamping plates 75 of each of the mounting sleeves 70 is provided with two opposite plugs 76 inserted into the two opposite slots 74 to combine the two clamping plates 75 of each of the mounting sleeves 70 together. Each of the two clamping plates 75 of each of the mounting sleeves 70 has an inner face provided with a retaining rib 71 locked in any one of the retaining grooves 61 of the respective upright post 60. Each of the two clamping plates 75 of each of the mounting sleeves 70 has a middle portion provided with an elongate slit 72 to make each of the two clamping plates 75 flexible. Each of the two clamping plates 75 of each of the mounting sleeves 70 has a lower end provided with an enlarged stop flange 73. Each of the two clamping plates 75 of each of the mounting sleeves 70 has a tapered outer face. Each of the fixing sleeves 82 of the frame 80 has an inner portion provided with a tapered locking hole 81 detachably locked onto the two clamping plates 75 of the respective mounting sleeve 70 and pressing the tapered outer face of each of the two clamping plates 75. Each of the fixing sleeves 82 of the frame 80 has a lower end abutting and stopped by the stop flange 73 of each of the two clamping plates 75 of the respective mounting sleeve 70.

However, when a user wishes to increase the number of the frame 80 or to adjust the position of the frame 80, the user has to remove the fixing sleeves 82 of the frame 80 from the mounting sleeves 70 and to remove the mounting sleeves 70 from the upright posts 60, and also has to reassemble the mounting sleeves 70 on the upright posts 60 and to reassemble the fixing sleeves 82 of the frame 80 on the mounting sleeves 70, thereby causing inconvenience to the user. In addition, when the locking hole 81 of each of the fixing sleeves 82 has a smaller size, the lower end of each of the fixing sleeves 82 cannot abut the stop flange 73 of each of the two clamping plates 75 of the respective mounting sleeve 70, and when the locking hole 81 of each of the fixing sleeves 82 has a greater size, a clearance is defined between the locking hole 81 of each of the fixing sleeves 82 and each of the two clamping plates 75 of the respective mounting sleeve 70.

BRIEF SUMMARY OF THE INVENTION

In accordance with the present invention, there is provided a combination shelf, comprising a plurality of upright posts, a plurality of mounting sleeves each detachably mounted on a respective one of the upright posts, at least one mounting frame mounted between the upright posts and detachably locked onto the mounting sleeves, a plurality of mounting brackets each detachably mounted on a respective one of the upright posts, and a plurality of support boards mounted between the upright posts and supported by the mounting frame and the mounting brackets.

The primary objective of the present invention is to provide a combination shelf whose support boards can be increased.

Another objective of the present invention is to provide a combination shelf, wherein the mounting brackets are detachably mounted on the upright posts to support the support boards so that the support boards are selectively mounted between the upright posts, and the number of the support boards can be adjusted freely and randomly according to a user's practical requirement, thereby enhancing the versatility of the combination shelf.

A further objective of the present invention is to provide a combination shelf, wherein each of the locking sleeves of the mounting frame is locked onto the respective mounting sleeve by a tapering engagement between the tapered locking hole of each of the locking sleeves and the tapered outer face of each of the two locking plates of the respective mounting sleeve, so that each of the locking sleeves of the mounting frame is combined with the respective mounting sleeve solidly and stably to enhance the stability of the combination shelf.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
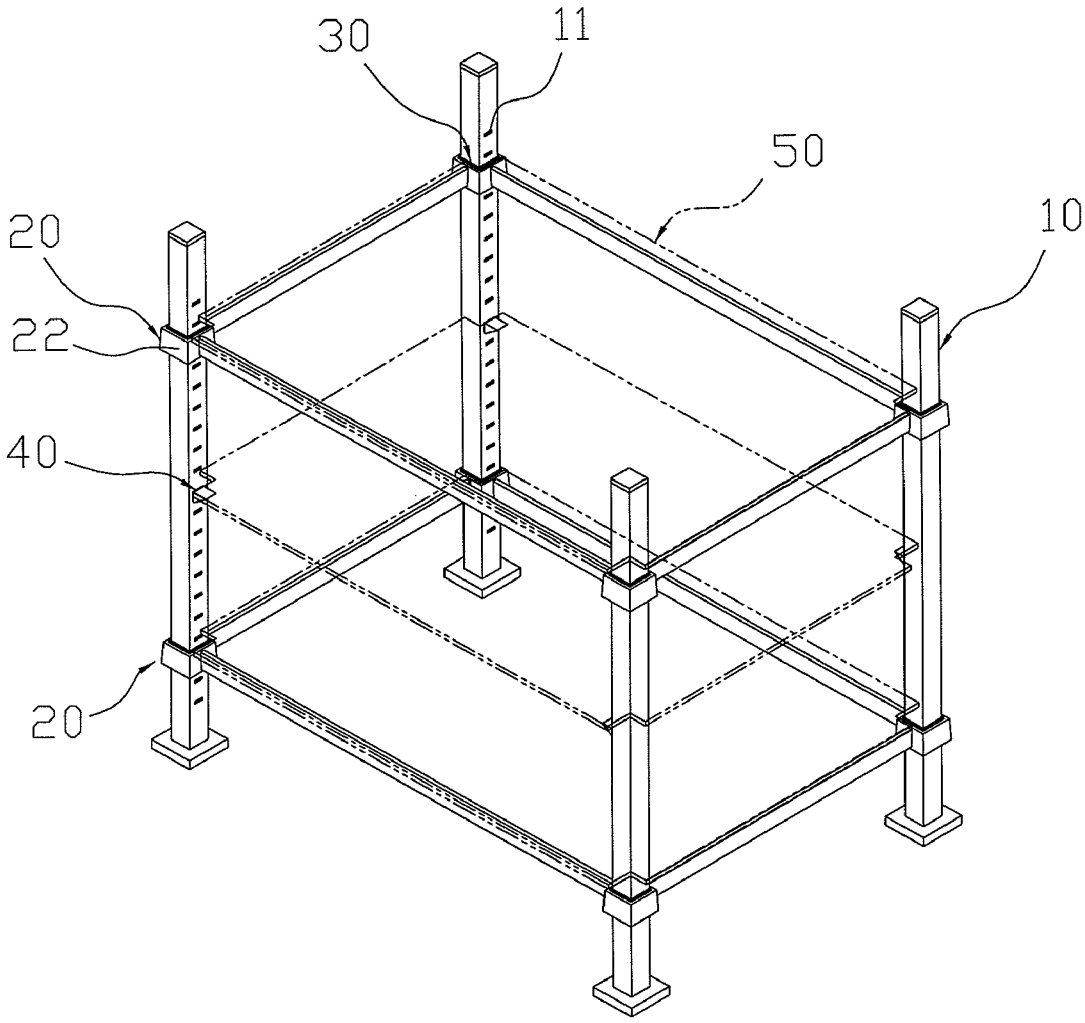
FIG. 1 is a perspective view of a combination shelf in accordance with the preferred embodiment of the present invention.
Figure 2:
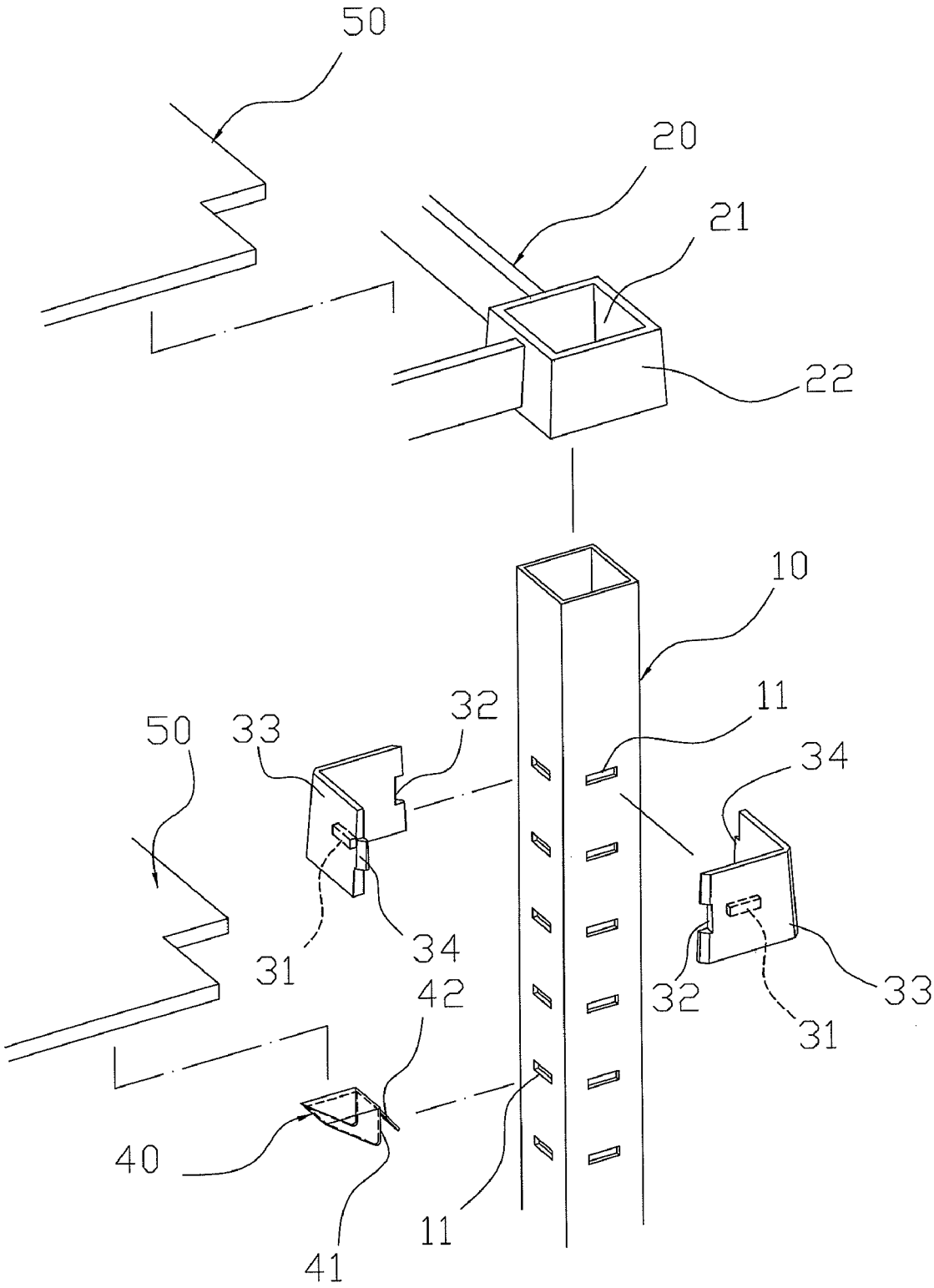
FIG. 2 is a partially exploded perspective view of the combination shelf as shown in FIG. 1.
Figure 3:
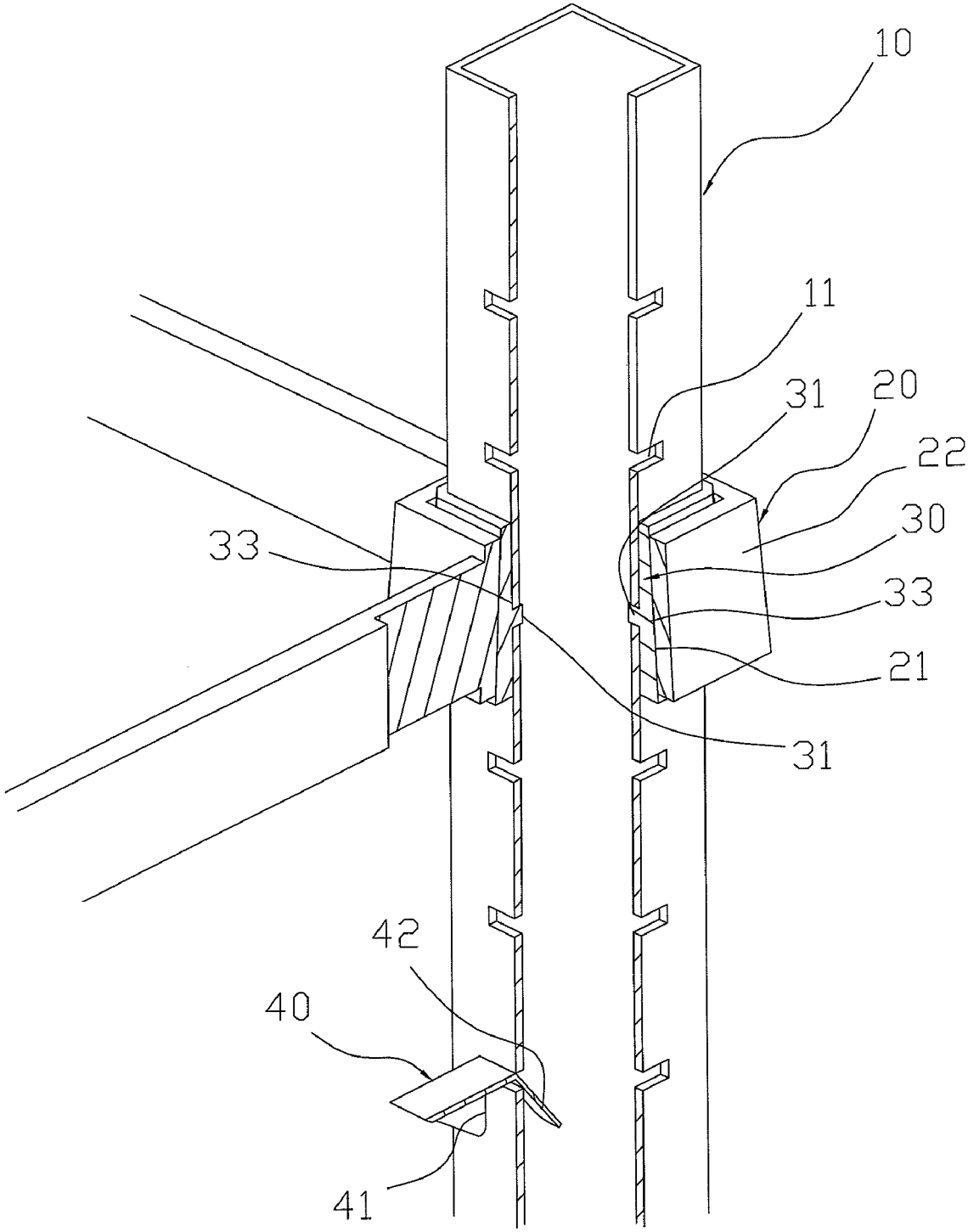
FIG. 3 is a partially cross-sectional perspective assembly view of the combination shelf as shown in FIG. 2.
Figure 4:
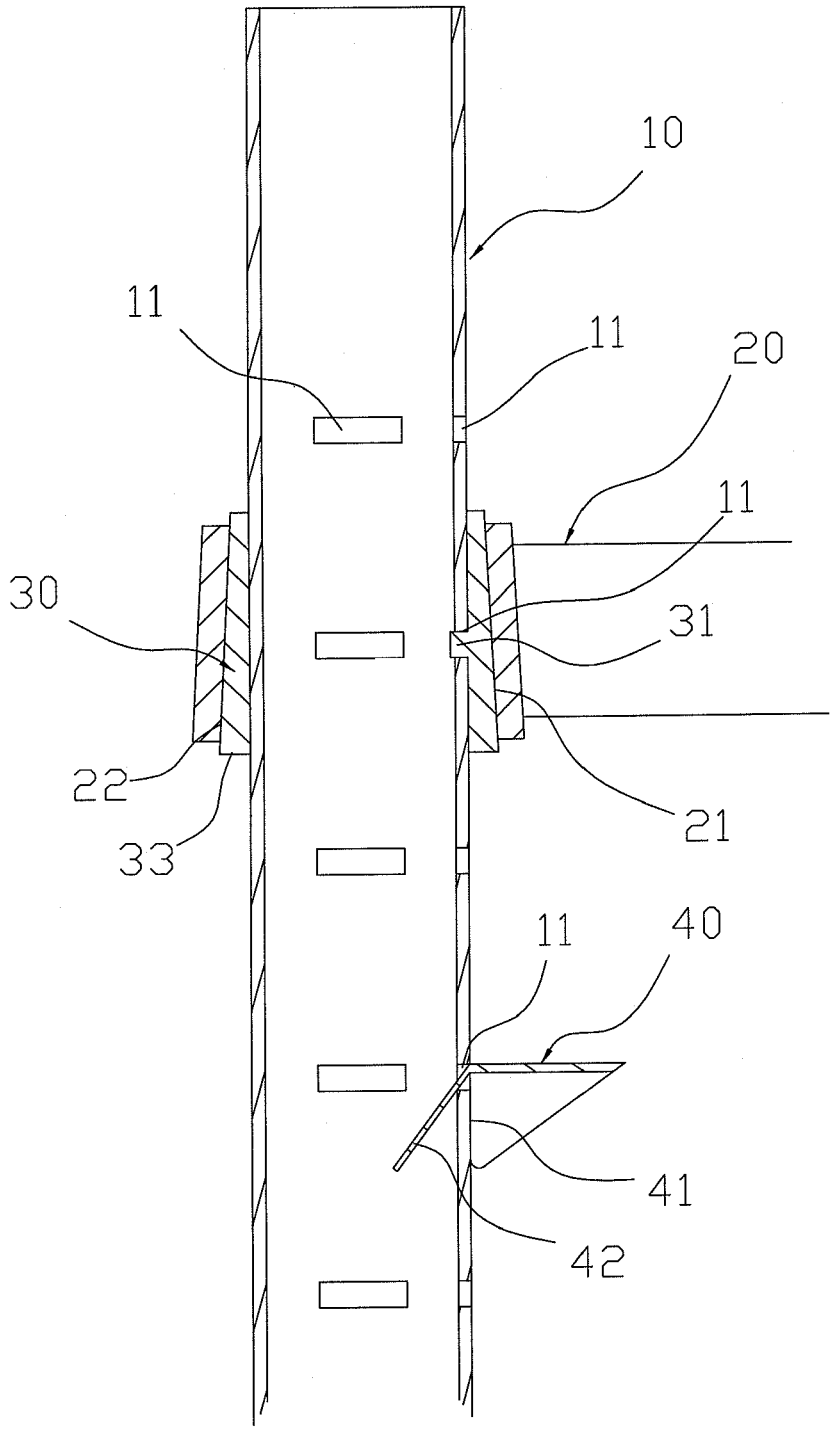
FIG. 4 is a side cross-sectional assembly view of the combination shelf as shown in FIG. 2.

Referring to the drawings and initially to FIGS. 1-4, a combination shelf in accordance with the preferred embodiment of the present invention comprises a plurality of upright posts 10, a plurality of mounting sleeves 30 each detachably mounted on a respective one of the upright posts 10, at least one mounting frame 20 mounted between the upright posts 10 and detachably locked onto the mounting sleeves 30, a plurality of mounting brackets 40 each detachably mounted on a respective one of the upright posts 10, and a plurality of support boards 50 mounted between the upright posts 10 and supported by the mounting frame 20 and the mounting brackets 40.

Each of the upright posts 10 has a peripheral wall provided with a plurality of locking slots 11. Each of the upright posts 10 has a substantially square shape. The locking slots 11 of each of the upright posts 10 are formed in at least two surfaces of each of the upright posts 10.

The mounting sleeves 30 are located at the same level. Each of the mounting sleeves 30 has a substantially square shape. Each of the mounting sleeves 30 includes two locking plates 33 detachably combined with each other and detachably mounted on the respective upright post 10 to clamp the respective upright post 10 between the two locking plates 33 of each of the mounting sleeves 30. Each of the two locking plates 33 of each of the mounting sleeves 30 has an inner face provided with a locking rib 31 detachably locked in a respective one of the locking slots 11 of the respective upright post 10. Each of the two locking plates 33 of each of the mounting sleeves 30 has a tapered outer face. Each of the two locking plates 33 of each of the mounting sleeves 30 has a substantially L-shaped profile and has a first end provided with a snap-fit block 34 and a second end provided with a snap-fit groove 32. The snap-fit block 34 of one of the two locking plates 33 of each of the mounting sleeves 30 is inserted into and detachably locked in the snap-fit groove 32 of the other one of the two locking plates 33 of each of the mounting sleeves 30 so that the two locking plates 33 of each of the mounting sleeves 30 are detachably combined together.

The mounting frame 20 is perpendicular to the respective upright post 10. The mounting frame 20 is provided with a plurality of locking sleeves 22 each detachably locked onto a respective one of the mounting sleeves 30. Each of the locking sleeves 22 of the mounting frame 20 has an inner portion provided with a tapered locking hole 21 detachably locked onto the two locking plates 33 of the respective mounting sleeve 30 and pressing the tapered outer face of each of the two locking plates 33.

The mounting brackets 40 are located at the same level. Each of the mounting brackets 40 is perpendicular to the respective upright post 10. Each of the mounting brackets 40 has a side provided with a resting plate 41 abutting an outer face of the respective upright post 10 and an insertion plate 42 inserted into a respective one of the locking slots 11 of the respective upright post 10. The insertion plate 42 of each of the mounting brackets 40 is inclined relative to each of the mounting brackets 40 and is inclined relative to the respective upright post 10. The resting plate 41 of each of the mounting brackets 40 is perpendicular to each of the mounting brackets 40 and is parallel with the respective upright post 10. The resting plate 41 of each of the mounting brackets 40 abuts the outer face of the respective upright post 10 when the insertion plate 42 of each of the mounting brackets 40 is fully inserted into the respective locking slot 11 of the respective upright post 10.

Figure 5:
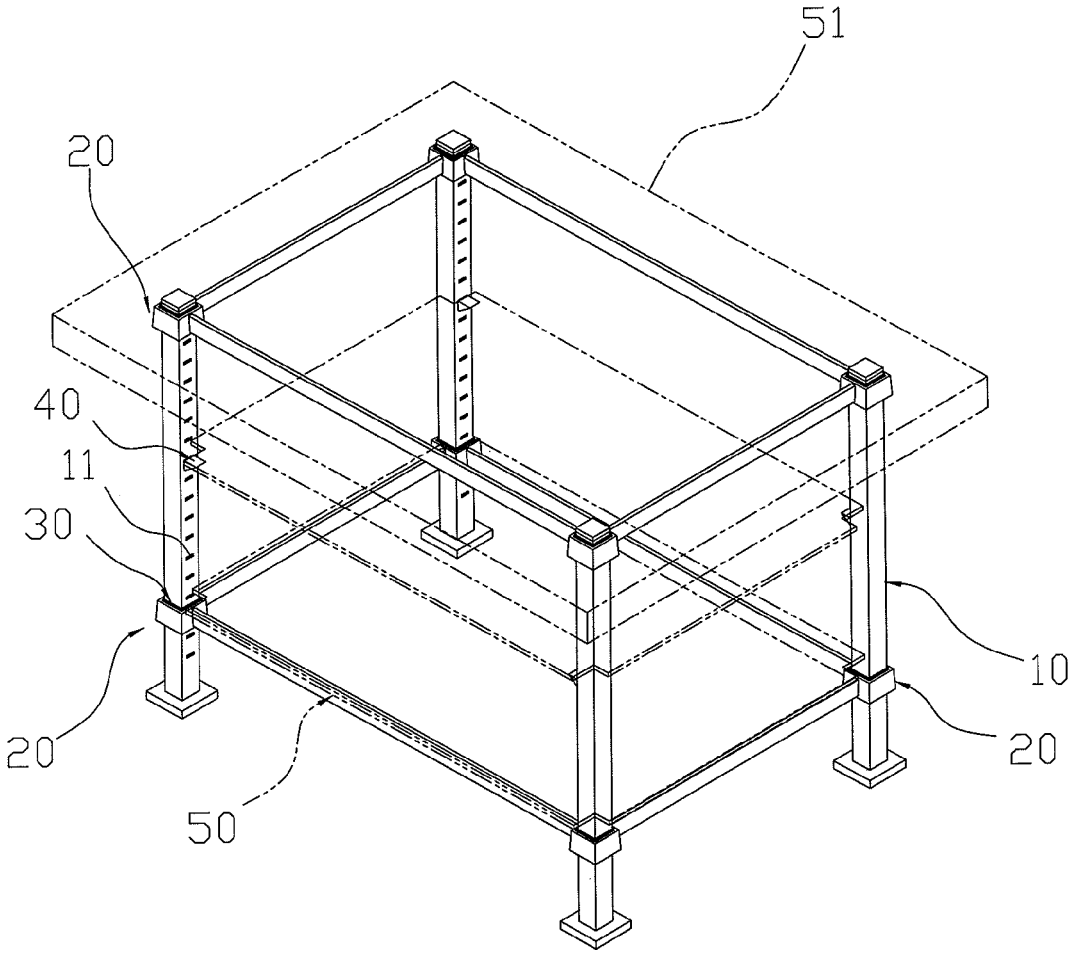
FIG. 5 is a perspective view of a combination shelf in accordance with another preferred embodiment of the present invention.
Figure 6:
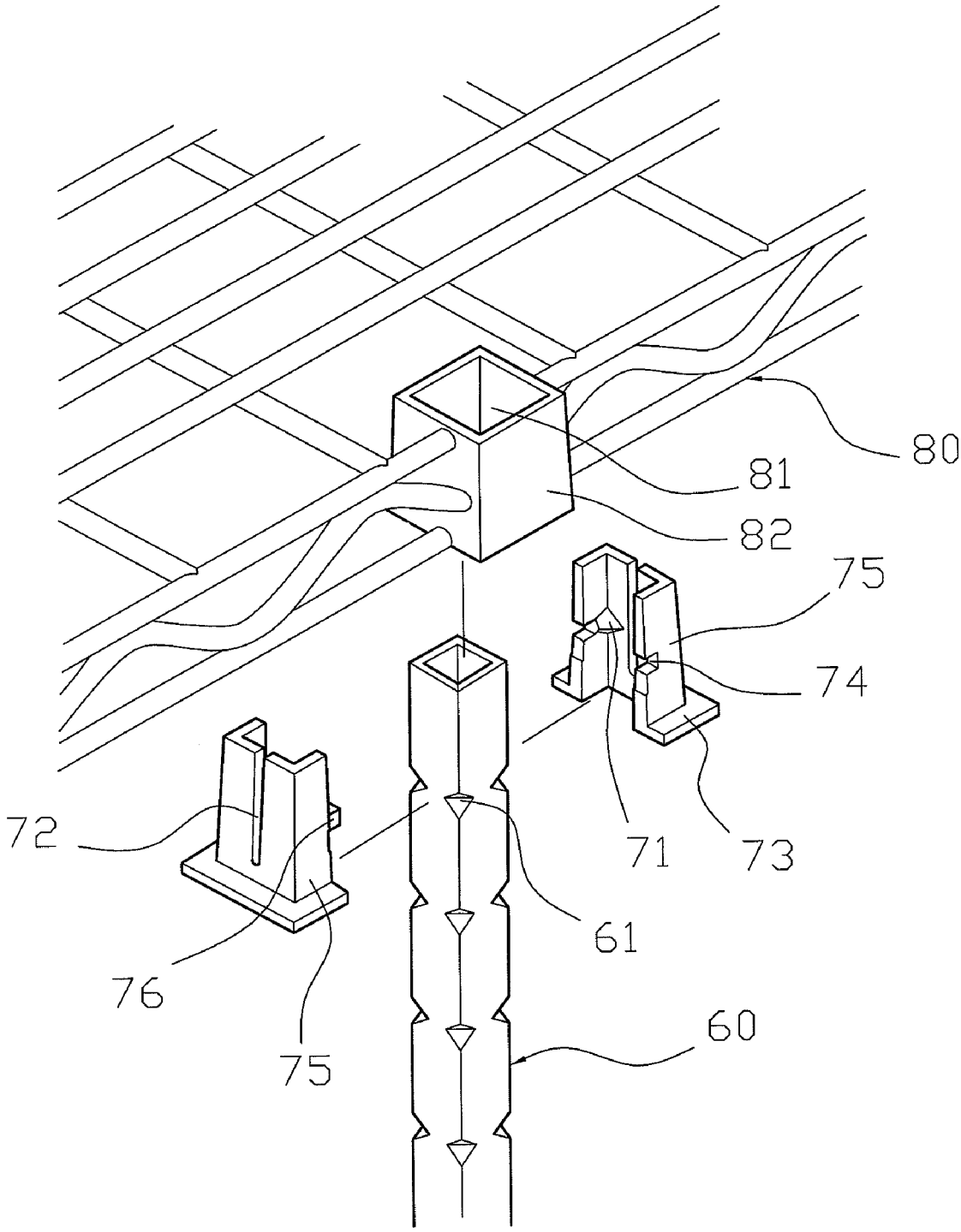
FIG. 6 PRIOR ART
FIG. 6 is a partially exploded perspective view of a conventional combination shelf in accordance with the prior art.
Figure 7:
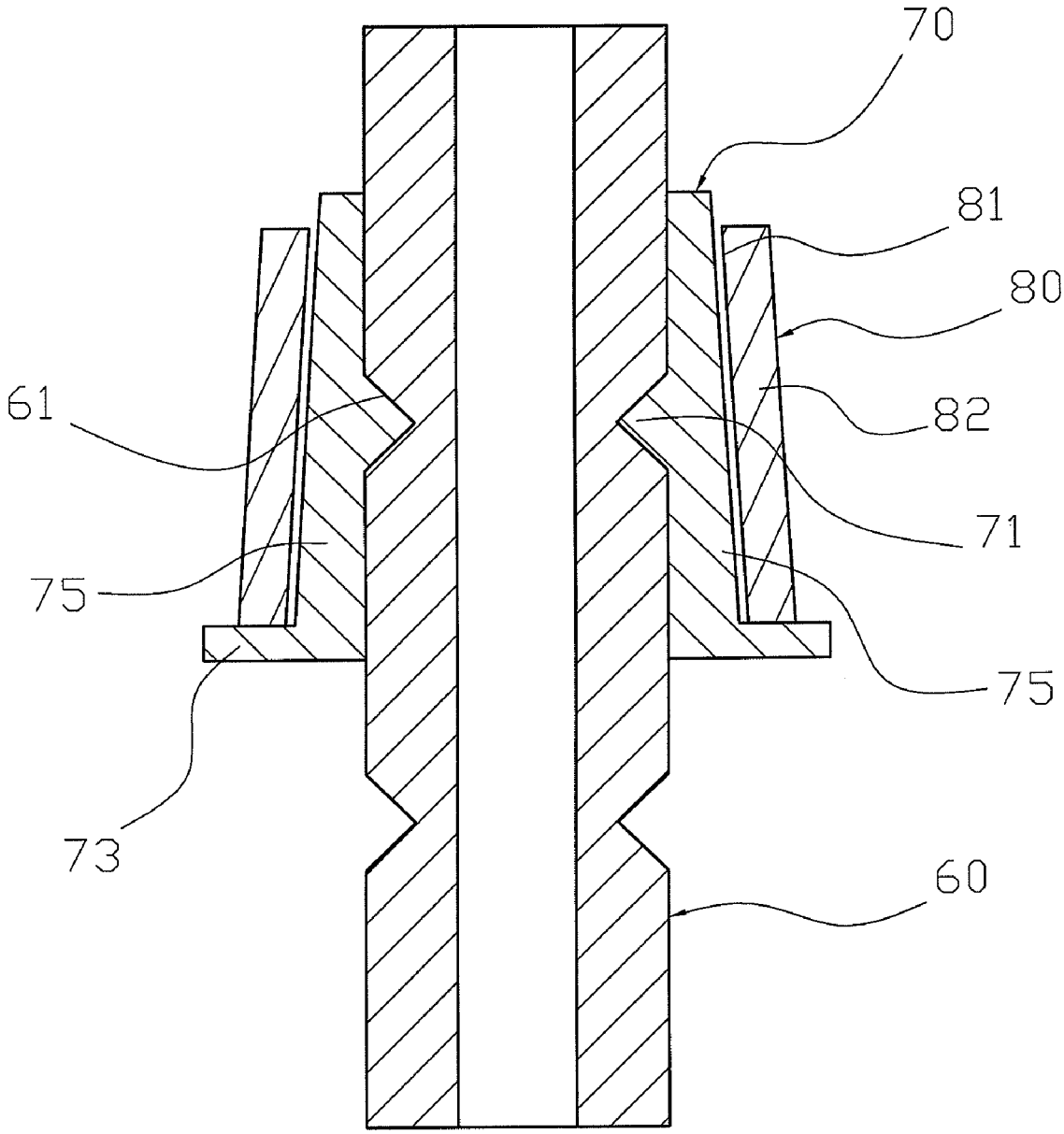
FIG. 7 PRIOR ART
FIG. 7 is a side cross-sectional assembly view of the conventional combination shelf as shown in FIG. 6.

Referring to FIG. 5, the combination shelf further comprises a table board 51 mounted on upper ends of the upright posts 10 and supported by the upright posts 10 so that the combination shelf functions as a table.

Accordingly, the mounting brackets 40 are detachably mounted on the upright posts 10 to support the support boards 50 so that the support boards 50 are selectively mounted between the upright posts 10, and the number of the support boards 50 can be adjusted freely and randomly according to a user's practical requirement, thereby enhancing the versatility of the combination shelf. In addition, each of the locking sleeves 22 of the mounting frame 20 is locked onto the respective mounting sleeve 30 by a tapering engagement between the tapered locking hole 21 of each of the locking sleeves 22 and the tapered outer face of each of the two locking plates 33 of the respective mounting sleeve 30, so that each of the locking sleeves 22 of the mounting frame 20 is combined with the respective mounting sleeve 30 solidly and stably to enhance the stability of the combination shelf.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination shelf, comprising:

a plurality of upright posts;

a plurality of mounting sleeves each detachably mounted on a respective one of the upright posts;

at least one mounting frame mounted between the upright posts and detachably locked onto the mounting sleeves;

a plurality of mounting brackets each detachably mounted on a respective one of the upright posts;

a plurality of support boards mounted between the upright posts and supported by the mounting frame and the mounting brackets;

wherein each of the upright posts has a peripheral wall provided with a plurality of locking slots;

each of the mounting brackets has a side provided with a resting plate abutting an outer face of the respective upright post and an insertion plate inserted into a respective one of the locking slots of the respective upright post.

2. The combination shelf of claim 1, wherein the insertion plate of each of the mounting brackets is inclined relative to each of the mounting brackets.

3. The combination shelf of claim 1, wherein the insertion plate of each of the mounting brackets is inclined relative to the respective upright post.

4. The combination shelf of claim 1, wherein the resting plate of each of the mounting brackets is perpendicular to each of the mounting brackets.

5. The combination shelf of claim 1, wherein the resting plate of each of the mounting brackets is parallel with the respective upright post.

6. The combination shelf of claim 1, wherein the resting plate of each of the mounting brackets abuts the outer face of the respective upright post when the insertion plate of each of the mounting brackets is fully inserted into the respective locking slot of the respective upright post.

7. The combination shelf of claim 1, wherein each of the mounting brackets is perpendicular to the respective upright post.

8. The combination shelf of claim 1, further comprising:

a table board mounted on upper ends of the upright posts and supported by the upright posts so that the combination shelf functions as a table.

9. The combination shelf of claim 1, wherein the mounting brackets are located at the same level.

10. The combination shelf of claim 1, wherein the mounting sleeves are located at the same level.

11. The combination shelf of claim 1, wherein each of the upright posts has a substantially square shape;

the locking slots of each of the upright posts are formed in at least two surfaces of each of the upright posts;

each of the mounting sleeves has a substantially square shape.

12. A combination shelf, comprising:

a plurality of upright posts;

a plurality of mounting sleeves each detachably mounted on a respective one of the upright posts;

at least one mounting frame mounted between the upright posts and detachably locked onto the mounting sleeves;

a plurality of mounting brackets each detachably mounted on a respective one of the upright posts;

a plurality of support boards mounted between the upright posts and supported by the mounting frame and the mounting brackets;

wherein each of the upright posts has a peripheral wall provided with a plurality of locking slots;

each of the mounting sleeves includes two locking plates detachably combined with each other and detachably mounted on the respective upright post to clamp the respective upright post between the two locking plates of each of the mounting sleeves.

13. The combination shelf of claim 12, wherein each of the two locking plates of each of the mounting sleeves has an inner face provided with a locking rib detachably locked in a respective one of the locking slots of the respective upright post.

14. The combination shelf of claim 12, wherein each of the two locking plates of each of the mounting sleeves has a substantially L-shaped profile.

15. The combination shelf of claim 12, wherein each of the two locking plates of each of the mounting sleeves has a first end provided with a snap-fit block and a second end provided with a snap-fit groove;

the snap-fit block of one of the two locking plates of each of the mounting sleeves is inserted into and detachably locked in the snap-fit groove of the other one of the two locking plates of each of the mounting sleeves so that the two locking plates of each of the mounting sleeves are detachably combined together.

16. The combination shelf of claim 12, wherein p1 each of the two locking plates of each of the mounting sleeves has a tapered outer face;

the mounting frame is perpendicular to the respective upright post;

the mounting frame is provided with a plurality of locking sleeves each detachably locked onto a respective one of the mounting sleeves;

each of the locking sleeves of the mounting frame has an inner portion provided with a tapered locking hole detachably locked onto the two locking plates of the respective mounting sleeve and pressing the tapered outer face of each of the two locking plates.

* * * * *